United States Patent [19]

Folk et al.

[11] Patent Number: 4,970,777

[45] Date of Patent: Nov. 20, 1990

[54] APPARATUS FOR CONNECTOR BLOCK LOADING OF ELECTRICAL LEADS

[75] Inventors: Kenneth F. Folk, Harrisburg, Pa.; William J. Woolley, Jr., Milwaukee, Wis.

[73] Assignee: AMP Incorporated, Harrisburg, Pa.

[21] Appl. No.: 511,499

[22] Filed: Apr. 20, 1990

[51] Int. Cl.[5] ..... H01R 43/00

[52] U.S. Cl. ..... 29/748; 29/759

[58] Field of Search ..... 29/747, 748, 759

[56] References Cited

U.S. PATENT DOCUMENTS 4,835,844 6/1989 Gerst et al. ..... 29/747

*Primary Examiner*—Carl E. Hall

[57] ABSTRACT

Apparatus (30) includes means (28,29) to position a block (12) having multiple apertures (14) with a given aperture positioned along a loading axis (IA); a series of linear driving motors (32,40,56,112) are sequentially operated to grasp, hold and transport a terminal wire (24) and insert the terminal (16) thereof into a selected block aperture (14) in a sequence with an inverse cam (90) and roller mechanism (80,94) driven by a lever (96) to convert linear motion into a particular curvilinear movement to cause the terminal to clear the wires previously loaded in apertures in the block in a high speed insertion cycle.

10 Claims, 4 Drawing Sheets

APPARATUS FOR CONNECTOR BLOCK LOADING OF ELECTRICAL LEADS

This invention relates to an apparatus for loading connector blocks of a type having multiple apertures with leads comprised of terminated wire.

BACKGROUND OF THE INVENTION

The need for automation of the manual steps of loading connector blocks with leads by inserting the terminals of such leads as terminated to wires into apertures of such blocks has existed for some time. U.S. Pat. No. 4,835,846 issued June 6, 1989 represents recent approach to the problem of automated block loading and the apparatus therein includes means to transfer terminated leads to a block loading position, insert a terminal in a block aperture and repeat such cycle in a selective and sequential manner. U.S. Pat. No. 4,404,743 issued Sept. 2, 1983 shows an alternative approach.

With respect to the problem in general and to the function of block loading in particular, a common goal is to provide the shortest cycle time represented by the steps of grasping a terminal lead, moving it into a position of alignment for insertion, inserting the terminal of the lead into an aperture of a connector block until it latches or is otherwise affixed therein, and returning to an initial or starting position; all with accuracy of movement for insertion, noninjury to parts, tooling life and ease of maintenance. Parameters that affect these desirable goals are the length of stroke of mechanisms to effect loading, the number of different movements and motions necessary to complete a given cycle, and the type of driving motors and motions necessary for their function.

Accordingly, it is an object of the invention to provide a block loading apparatus for loading leads comprised of terminated wires into the apertures of a connector block in a high speed highly reliable manner. It is a further object to provide a block loading apparatus having short positive strokes and movements controlled by fixed stroke cycles to operate in a rapid and reliable manner.

It is yet another object of the invention to provide an apparatus capable of loading the apertures of connectors repetitively through a lead movement controlled to avoid previously inserted leads as defined by a highly reliable cam and roller mechanism.

SUMMARY OF THE INVENTION

The apparatus of the invention accommodates connector blocks of a type having rows and columns of apertures which can be selectively loaded with leads by the insertion of a terminal terminated to a wire in a given aperture. The apparatus includes a means to move a block repeatedly and sequentially to present an aperture to be loaded in alignment with and centered on a predetermined and fixed loading axis. Proximate to and as close as is practicable a pair of clamp and driving mechanisms are operated to grasp and hold a terminated lead, one of the clamps surrounding the terminal of the lead in a sliding and guiding engagement therewith and the other clamp firmly grasping the wire of such lead a given distance behind the terminal thereof. The two clamps are in a preferred embodiment driven by air cylinders to effect the clamping function and are carried for sliding movement in a yoke and connected to a further driving means which is in a preferred embodiment an air cylinder. The yoke which mounts the various driving means is itself further carried by a shaft coupled to an inverse cam driven by a roller in turn driven by a lever connected to a further driving means, also in the form of an air cylinder in a preferred embodiment. The inverse cam and roller combination convert the arcuate movement of the lever to a particular and consistent curvilinear movement carrying the clamping means and thereby the terminal and wire in an up and around motion which causes the tooling and the terminals to clear previously inserted leads relative to the connector block. At that point in the cycle the second mentioned driving means is operated to drive the wire clamp axially forward driving the terminal through the first clamping means and into the aperture to a point of latching to effectively load the block. The various driving means then reverse with the clamping means being carried back to initial wire loading position and in an open condition for the next cycle. In this way, purely linear motions from the driving means are converted into a series of short steps resulting in the positioning and insertion of a lead in a block in a manner precluding interference with previously loaded wires and in a repetitive manner which can be run at high speeds and short cycle times notwithstanding the different positions of apertures in a block.

IN THE DRAWINGS

DETAILED DESCRIPTION OF THE INVENTION

Figures 1, 2:
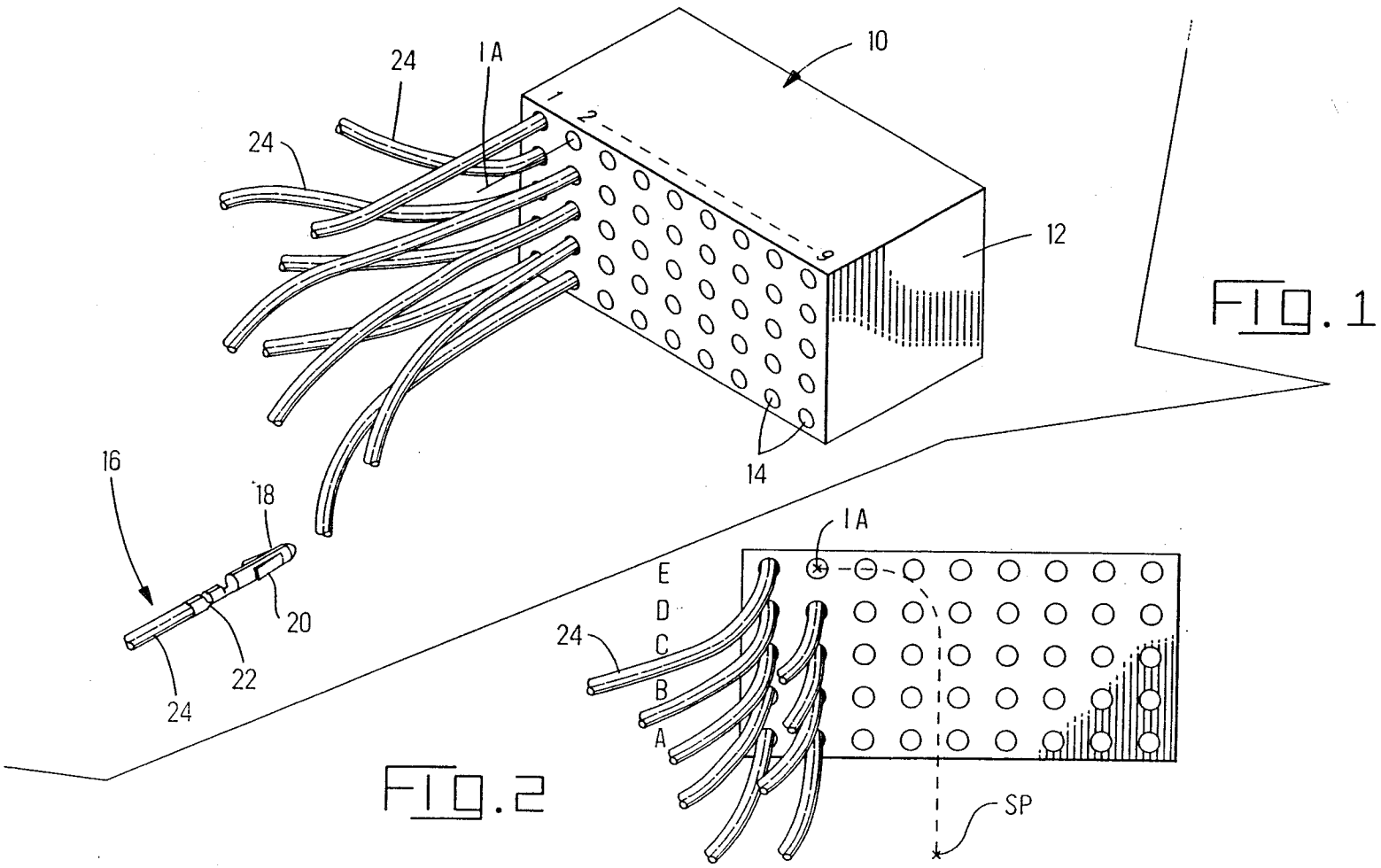
FIG. 1 is a perspective and schematic view of a connector block partially loaded with leads, a terminated lead being shown preparatory to insertion in a column partially loaded with such leads.
FIG. 2 is a front on elevational view of the block of FIG. 1.

In FIG. 1 a harness unit 10 is shown to be comprised of a connector block 12 which contains multiple apertures 14 arranged in a series of columns numbered 1–9 and a series of rows as shown in FIG. 2 denominated A–E. The objective of the invention and the apparatus it embraces is to effect the loading of block 12 by the insertion of leads shown as 16 in FIG. 1, each comprised of a terminal 18 terminated as by crimping indicated at 22 to a wire 24. The terminal includes as shown in FIG. 1 at least one lance element 20 which serve to latch the terminal into an aperture 14 within block 12 by engagement with an interior transverse surface not shown but well understood to be featured in connector blocks. The leads 24, numbers of which are shown in FIGS. 1 and 2 to be inserted, can be seen to protrude from the rear face of block 12. In accordance with the invention concept, block 12 is loaded with the first aperture, aperture A-1, referring to the row and column denominations, loaded first and with the remainder of column 1 including the apertures therein B–E are loaded sequentially thereafter. Next in a block loading cycle the aperture denominated A-2, the bottom aperture of the second column, is loaded with the apertures above such being sequentially loaded thereafter. This process continues until the block 12 is loaded in a pattern desired, sometimes with all apertures loaded and on occasion with only selected ones of the apertures being loaded to define a given set of circuits. As can be discerned from FIGS. 1 and 2 the insertion of a lead 16 in aperture 1A precludes movement upward to aperture 1B and indeed to the remaining apertures of a given row. Thus, with respect to the showing in FIGS. 1 and 2, it is necessary for a lead to be caused to approach the next aperture to be loaded, in this illustration aperture 2-E along an axis centered on such aperture, such axis being denominated IA representing an insertion axis. In accordance with the invention a lead comprised of the terminated wire is brought to an initial cycle starting position denominated in FIG. 1 as SP and thereafter through operation of the apparatus of the invention transported from a position below and to the right of IA of the selected aperture to be loaded along the dotted path shown in FIGS. 1 and 2. As can be discerned the movement of the lead is essentially up and around the previously loaded apertures, the leads thereof and then in toward and into the chosen aperture. In this way previously installed leads are avoided.

Figure 3:
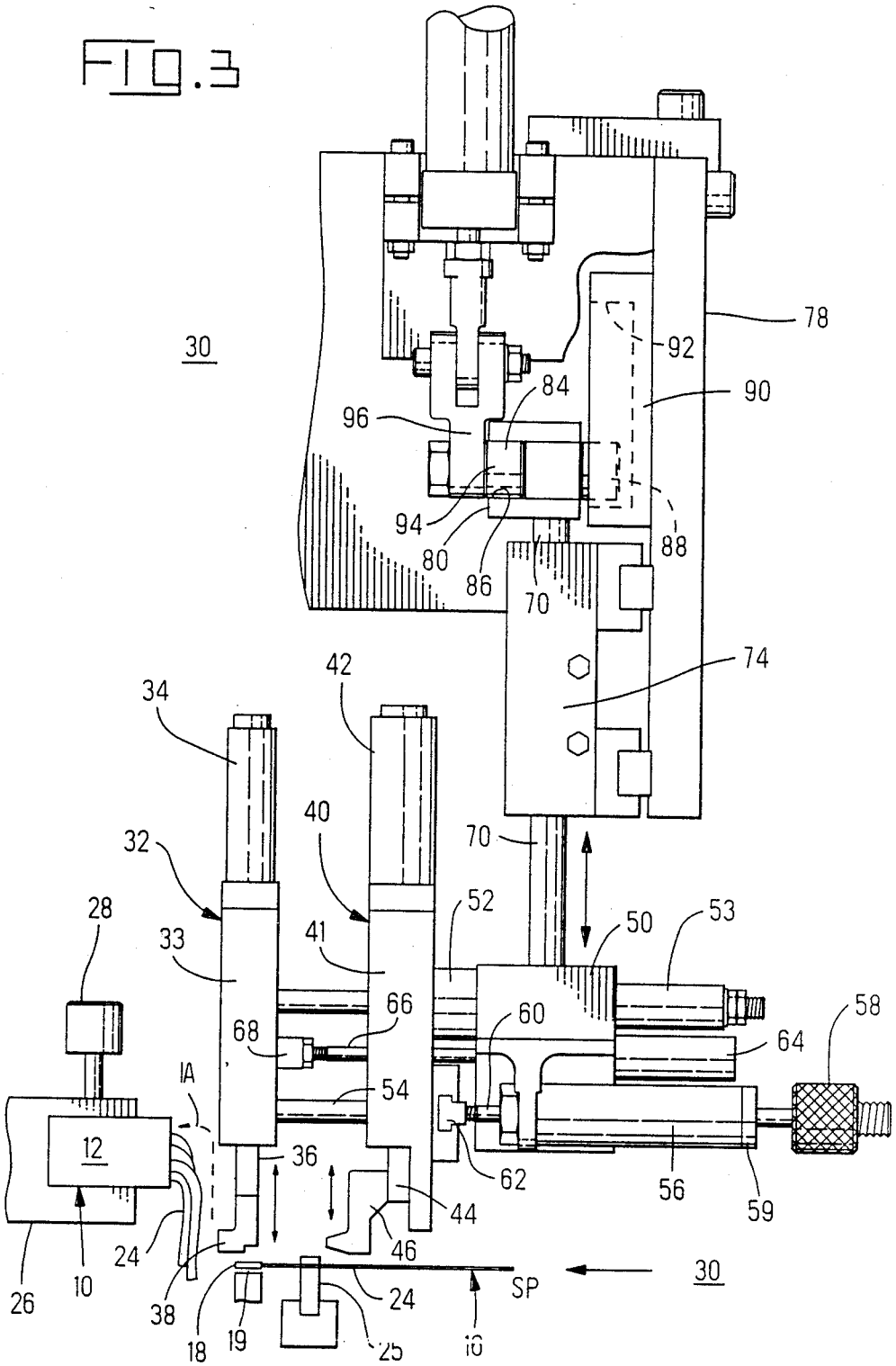
FIG. 3 is a side and elevational view of the apparatus of the invention shown in an initial position preparatory to a function cycle.

Referring now to FIG. 3, the starting position SP of a lead 16 is shown relative to a block 12 and the insertion axis IA. Lead 16 is preterminated and fed to the loading station as by a conveyor denominated 25 having a suitable clamp mechanism holding the lead in position with the terminal 18 thereof supported by a suitable guide shown as 19. Leads 16 are preferably prepared by automatic machinery and loaded into conveyors and carried to the starting position. There, the block 12 is indexed so that the next aperture to be loaded is aligned along the insertion axis IA shown in FIG. 3. The block 12 is preferably held in a block carrier denominated 26 in FIG. 3 and 4 which in turn is driven in X and Y directions by a pair of drivers shown as 28 and 29 in FIG. 4 which in turn can be driven in sequences to position a given aperture along IA. The movement of block 12 is coordinated with the cycling of the apparatus shown as 30 in FIGS. 3 and 4 by an overall control circuit which may preferably include a series of electrical control signals generated as by an electronic controller which in turn drives air logic and air cylinders or other suitable actuators in a sequence to effect a block loading cycle.

The apparatus 30 includes to the left in FIG. 3 a first clamp element 32 actuated as by a motor in the form of an air cylinder 34 to operate a clamping mechanism shown as 36 to cause a clamp structure 38 to grasp and hold the lead terminal 18 positioned therebelow in a manner to allow the terminal to be slidably engaged therein but accurately positioned relative to 38. Clamp 32 operates when cycled to extend 36 downwardly, opening a pair of jaws carrying the tooling 38 to a position overlying terminal 18 and when cycled close 38 around 18.

A further clamp 40 including an actuator 42 preferably in the form of an air cylinder operates in a similar manner to extend jaws 44 downwardly opening tooling 46 to overlie wire 24. When the clamp 40 is actuated the clamping jaw portions of 46 close to tightly grip wire 24. In practice, both clamps 32 and 40 are actuated together to result in the lead being held, the terminal 18 held but slidingly engaged by 38 and wire 24 tightly gripped by 46.

The clamps 32 and 40 are held by a yoke 50 for sliding movement in a horizontal sense relative to such yoke, toward and away from the block 12 by a shaft 52 engaging clamp 40. A pair of rods 54 join clamp 32 to clamp 40. A linear actuator 56 in the form of an air cylinder is connected to the yoke 50 and the actuator includes a stroke adjustment element 58 which on the lefthand travel is made to engage a urethane bumper shown as 59 to limit impact shock to the apparatus. Actuator 56 includes a shaft 60 linked as at 62 to clamp 40 and operable upon 56 being cycled to drive 40 and through the links 54 to drive 32 to the left in an insertion cycle. At this point in the cycle the lead 16 as carried in the clamps 32 and 40 will have been positioned to be along axis IA so that movement of the clamps will insert lead 18 in the selected aperture. As this occurs the actuator 56 continues to drive to the left to force the gripped wire 24 to insert the terminal fully within the block aperture. In accordance with the invention this full insertion occurs when the lance 20 of the terminal engages the locking surface heretofore mentioned within the aperture of the block. The clamp 42 is made to slide on rods 54 toward clamp 32 as driven by 56. In a return cycle actuated by 56 the clamp 40 is returned to the right as shown in FIG. 3 with a dash pot 64 operating through a shaft 66 and a linkage 68 to hold clamp 32 relative to such motion with clamp 40 being retracted to a proper spacing of the tooling of clamps 32 and 40 and both clamps being retracted to the position shown in FIG. 3. Suitable bumper mechanisms in the form of coil or urethane springs or combinations thereof, are provided within the apparatus element 53 to absorb shock on the retraction cycle.

Figure 4:
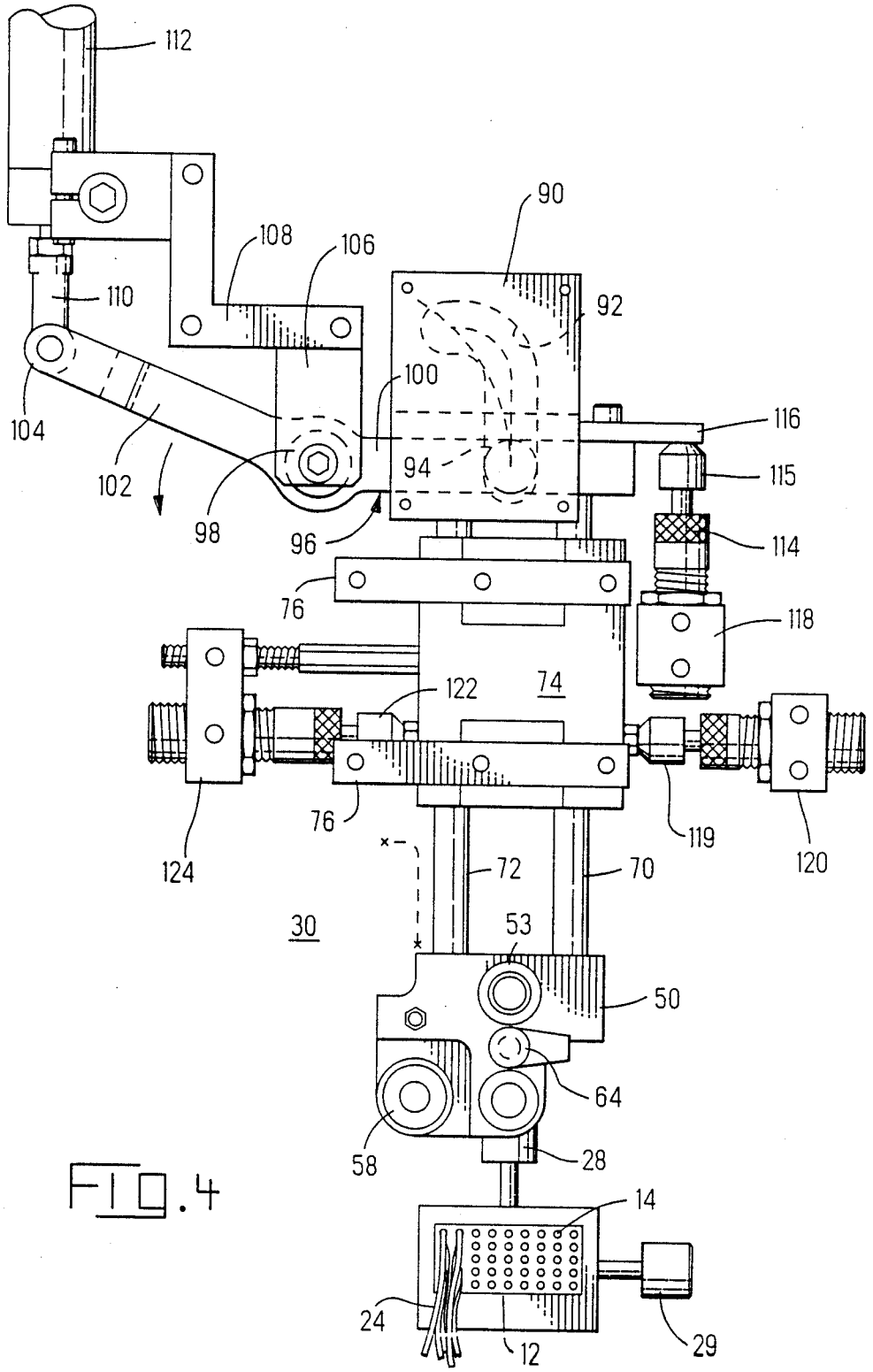
FIG. 4 is an end view of a portion of the apparatus shown in FIG. 3 with the inverse cam mechanism thereof shown in phantom.
Figure 5:
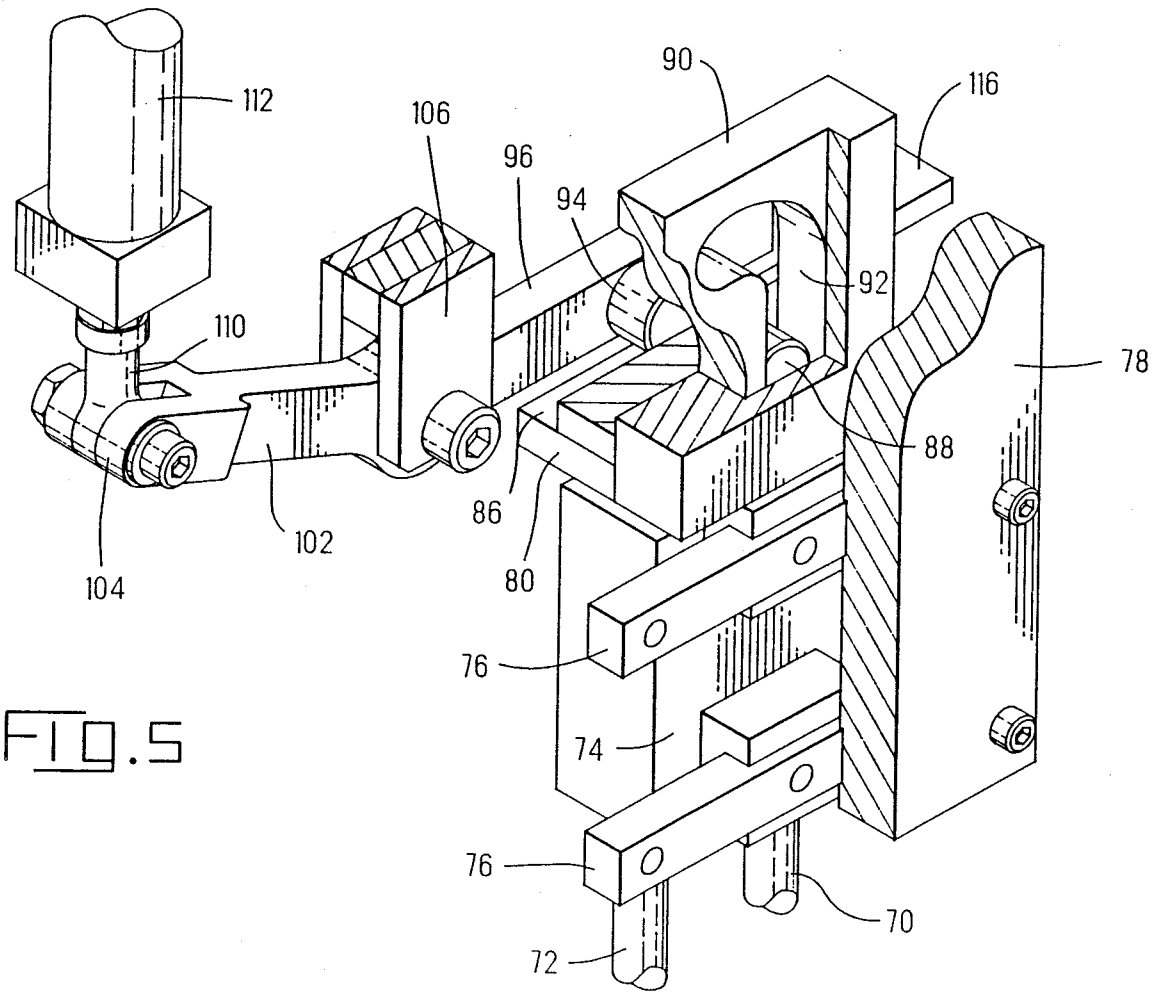
FIG. 5 is a perspective shown in partial section of the inverse cam, roller, lever and linear motor shown in FIGS. 3 and 4.

Prior to the foregoing cycle of insertion the yoke 50 is moved upwardly to carry the clamps and the driving actuators as well as the tooling thereof and leads 16 upwardly from the position shown in FIG. 3 to a point of alignment with IA. This upward and later downward movement is effected through shafts 70 and 72 shown in FIG. 4 supported in a block housing 74 for sliding movement. The block 74 is held by a pair of supports 76 as shown in FIGS. 4 and 5 in turn tied to a fixed support 78 suitably anchored to the base of the apparatus. Referring to FIG. 3 the upper ends of the shafts 70 and 72 can be seen to be joined to a block 80 which contains a slot 84 having upper and lower bearing surfaces 86 contained therein. Block 80 includes protruding from one side thereof in the manner shown in FIGS. 3–5 a roller 88 which is fitted within an inverse cam 90 having a particular curvilinear interior surface 92 which guides and confines the roller 88 therewithin. Fitted within the slot 84 is a further roller 94 affixed to a lever 96 pivotally mounted as at 98 as shown in FIG. 4 with a driven arm 102 pivotally mounted to be driven by an actuator. The lever 96 is carried by support 106–108 in turn clamped to the apparatus housing and base. A link 110 connected as at 104 is driven by an actuator 112, preferably an air cylinder.

As will be appreciated from FIG. 4 operation of actuator 112 will cause lever 96 to rotate, its structure moving in an arcurate or rotary fashion. That movement in turn will tend to drive roller 88 in similar motion which will, in turn, drive block 80 upwardly, roller 94 moving in block 80 to free block 80 for transverse movement. The movement of block 80 and the shafts 70, 72 and thus the yoke 50 will be modified or modulated by the engagement of roller 88 against the surfaces 92 of inverse cam 90. The shafts 70 and 72 carrying yoke 50 and the various clamps and actuators attached thereto thus are made to move in the particular accurate movement so defined. This in turn moves the leads 16, the terminal thereof and the wire in a path to avoid a previously loaded lead.

As shown in FIG. 4 a number of adjustable bumper mechanisms are included. These serve to absorb the shocks of the apparatus when driven at high speeds in short cycle times. Thus, there is included to absorb vertical shock by engagement with a bar 116, part of block 84, a bumper including an adjustable portion 114, a resilient element 115 both carried on support 118. Horizontal bumpers may be utilized to absorb insertion and retraction motions of block 74. Thus, a resilient bumper 119 carried by support 120 operates to absorb rightward movements of the apparatus by an engagement with block 74. Similarly, a leftward resilient bumper 122 supported as at 124 can be adjusted to accommodate leftward movement of the block 74 and the apparatus.

In summary, the apparatus of the invention includes a cycle which embraces a first movement of a block to align selected aperture with an axis of insertion. Preterminated leads are delivered by a conveyor to an initial start position. Thereafter clamping actuators are cycled to cause a clamping of a prefed lead which is then driven in an up and around motion to cause the leading clamp tooling to clear previously inserted wires and thereafter further driven to insert a terminal within the selected aperture. The second clamp travels in a manner to push the wire associated with the terminal to force the terminal into an aperture causing it to latch within a housing with the tooling then opening and returning to an initial position. All of the actuators are linear with the appropriate motion provided by a solid inverse cam roller mechanism and strokes provided by the apparatus are constant in length and direction. In an actual apparatus the movement of the clamps in a vertical sense was on the order of less than half an inch, the overall vertical movement including the upper portion of the apparatus was on the order of 2½ inches and the horizontal movement engaging the clamp tooling portions with the block was on the order of 0.75 inches with the follow-up movement of the wire clamp on the order of a little more than 2 inches.

Having now described the invention in terms intended to enable those skilled in the art to practice its apparatus, the invention is defined by the appended claims:

We claim:

1. Apparatus for block loading leads of a type having a terminal terminated to a wire through the insertion of a terminal into an aperture of a connector block where said block includes a number of apertures to be loaded in sequence and wherein a previously loaded lead precludes an access path to the next aperture to be loaded, said apparatus comprising first means operable to position a block with an aperture to be loaded centered upon a loading axis, second means operable from an initial cycle condition to grasp and hold a lead at a lead supply point specially removed from said block, third means operable to drive the said second means and said lead from said supply point up and around a previously loaded aperture to a point of alignment with said axis and fourth means operable to drive said first means to insert said lead, the terminal thereof into the aperture positioned on said axis to a point of latching of the terminal within the said block, and control means operable to restore said second, third and fourth drive means to the initial cycle condition preparatory for the next cycle.

2. The apparatus of claim 1 wherein the said second drive means includes first and second clamp means with said first clamp means having tooling shaped to grasp a terminal for sliding movement and said second drive means having tooling to tightly grip a wire terminated to said terminal with said third driving means operating to push said first and second driving means along said axis whereby said wire is driven axially to drive said terminal axially within said block.

3. The apparatus of claim 2 wherein the said second, third and fourth driving means include linear motors and the said third driving means includes a cam to convert linear movement into the desired up and around movement to clear previously loaded apertures.

4. The apparatus of claim 1 wherein the said third driving means includes a linear motor connected to drive a lever in arcurate movement with there being further included an inverse cam defining movement of a roller connected to said lever to drive said second and fourth driving means in said up and around movement.

5. The apparatus of claim 1 wherein the said driving means include linear actuators in the form of air cylinders.

6. Apparatus for loading terminals terminated to wires into apertures of connector blocks including positioning means operable to present a lead comprised of a terminal and wire at a starting position, first means operable to close over said terminal and support said terminal for axial sliding movement, second means operable to grip said wire tightly a given distance from said terminal, third means operable to drive said first and second means together in a movement parallel to the face of the connector block whereby the said terminal and the said first means clear wires previously in apertures in said block and into a position of alignment with an aperture to be loaded, and fourth means to drive the said second means and the said lead wire and terminal axially pushing said terminal into said aperture to a point of latching thereof, said apparatus including further control means to drive the said drive means in a return retraction cycle to said starting position.

7. The apparatus of claim 6 wherein the said third driving means includes a linear drive motor connected to a lever driving an inverse cam and roller follower having a cam surface shaped to modulate linear movement to an appropriate curvilinear movement to effect clearance of said first means of preloaded wires.

8. The apparatus of claim 1 including means connecting said first, second and fourth means to be supported and driven by said third means in said movement.

9. The apparatus of claim 6 wherein said various drive means include air operated linear motors and said control means is operable to drive said motors in fixed stroke cycles repetitively throughout the loading of a said block with leads.

10. The apparatus of claim 6 including a block driving means operable to drive a block to present an aperture at a given loading position.

* * * * *